United States Patent [19]

Hutchison

[11] 4,385,663

[45] May 31, 1983

[54] PACKERLESS WELL COMPLETION ASSEMBLY

[75] Inventor: Stanley O. Hutchison, Bakersfield, Calif.

[73] Assignee: Chevron Research Company, San Francisco, Calif.

[21] Appl. No.: 289,548

[22] Filed: Aug. 3, 1981

[51] Int. Cl.[3] ..... E21B 33/10; E21B 41/00; E21B 43/24

[52] U.S. Cl. ..... 166/378; 166/67; 166/303; 166/382; 166/387

[58] Field of Search ..... 166/206-208, 166/382, 378, 379, 380, 387, 67, 242, 68, 88, 303; 285/140, 142

[56] References Cited

U.S. PATENT DOCUMENTS

| | | | |
|---|---|---|---|
| 2,042,745 | 6/1936 | Thompson | 166/68 |
| 3,154,148 | 10/1964 | Peterson | 166/88 |
| 3,373,819 | 3/1968 | Baker | 166/88 |
| 3,721,296 | 3/1973 | Tubbs | 166/191 |

*Primary Examiner*—Stephen J. Novosad
*Assistant Examiner*—Joseph Falk
*Attorney, Agent, or Firm*—G. W. Wasson; Edward J. Keeling

[57] ABSTRACT

A subsurface well bore completion assembly without convention inflatable or cup packer elements. The completion is effected by cementing a member having an internal sealing surface in place within the well then running tubing string terminating with a sealing adapter having matching sealing face into the cemented member and sealing said well by pressing the surface and face together under the weight of the tubing string.

7 Claims, 9 Drawing Figures

PACKERLESS WELL COMPLETION ASSEMBLY

This invention relates to a subsurface completion assembly for use in a well bore and more particularly to a packerless subsurface completion assembly for a petroleum well.

BACKGROUND OF THE INVENTION

Prior Art

In the production of petroleum crude from subsurface formations containing highly viscous crude, it has become the practice to inject into the formations a steam or hot fluid for the purpose of increasing the temperature of the formation, thus increasing the mobility of the crude so that it may flow from the formation into a producing well. Apparatus for use in such a production arrangement generally includes a means at the wellhead for generating the steam or hot fluid and a cased well including injection tubing that is used for transporting the steam or hot fluid from the surface to the subsurface location. At the subsurface location a packer is usually provided to prevent the steam or hot fluids from flowing back up the annulus between the injection tubing and the casing thus insuring that the steam is forced into the formation for heating the viscous crude in place.

The packers that had been used with such a subsurface formation completion scheme have functioned adequately when the temperature of the injection fluid and the pressures at the subsurface are reasonably low. However, as temperatures and pressures have increased, to the ranges of 550° to 650° F. and 2000 to 2500 psi, it has been found that the available subsurface packers have not been capable of maintaining an adequate seal in the annulus and the injection fluid sometimes bypasses the packer and fills the annulus within the casing between the injection string and the casing. Such a bypass of the injection fluid has two serious consequences in a steam injection well. Firstly, the steam surrounding the injection string provides a heat conduction path for withdrawing heat from the injection string and in that way reduces the amount of heat that is actually injected into the petroleum containing formation. Secondly, the loss of injection fluids into the annulus reduces the amount of fluids that will be transported back into the formation to accomplish the desired heating of the formation. An improved subsurface packing assembly and injection scheme is therefore desirable in the petroleum industry.

SUMMARY OF THE INVENTION

In accordance with the present invention, a subsurface completion of an injection well is produced by firmly cementing a packerless completion assembly into the subsurface formation above the location where the injection of hot fluid is to be accomplished. The completion assembly incorporates a simplified sealing arrangement that produces a subsurface seal of the injection string into the cemented casing. A complete seal of the subsurface well is accomplished by mechanical engagement between a portion of the injection tubing string and the cemented subsurface completion assembly.

The objects and features of the present invention will be readily apparent to those skilled in the art from the appended drawings and specification illustrating a preferred embodiment wherein.

Figure 1:
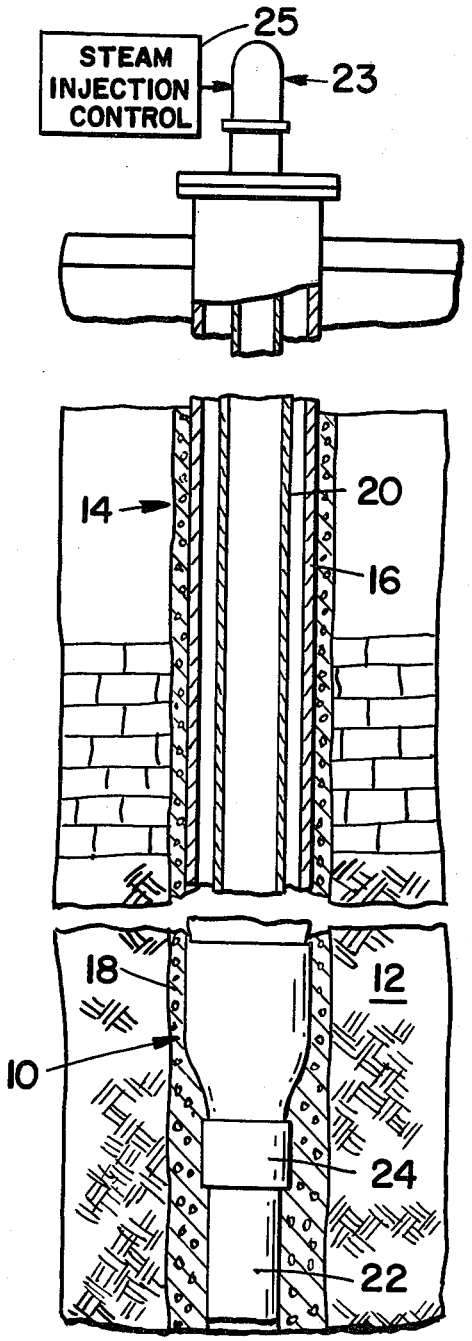
FIG. 1 is a schematic vertical sectional view through an earth formation illustrating the packerless completion assembly of the present invention in position in the subsurface and in cooperation with surface equipment at the earth surface.

FIG. 1 illustrates the packerless completion assembly of the present invention in position in a well bore penetrating an earth formation. As illustrated, the packerless completion assembly 10 is located in the petroleum containing formation 12 which is penetrated by a well bore 14 completed with a casing 16 cemented to the formation 12 by cementing material 18. An internal tubing string 20 which may be either an injection or a producing string is located within casing 16. A reduced diameter casing 22 is joined to the lower end of the completion assembly 10 at a coupling 24 and, for the purpose of a steam injection well, the lower casing 22 is also cemented to the formation below the completion assembly.

At the earth surface the casing 16 and internal injection string 20 are completed for the purpose intended. In the case here illustrated, a steam injection control 25 is illustrated connected to the exposed end of the injection string. The wellhead equipment is not a part of the present invention and for that reason, it will not be further described.

Figure 2:
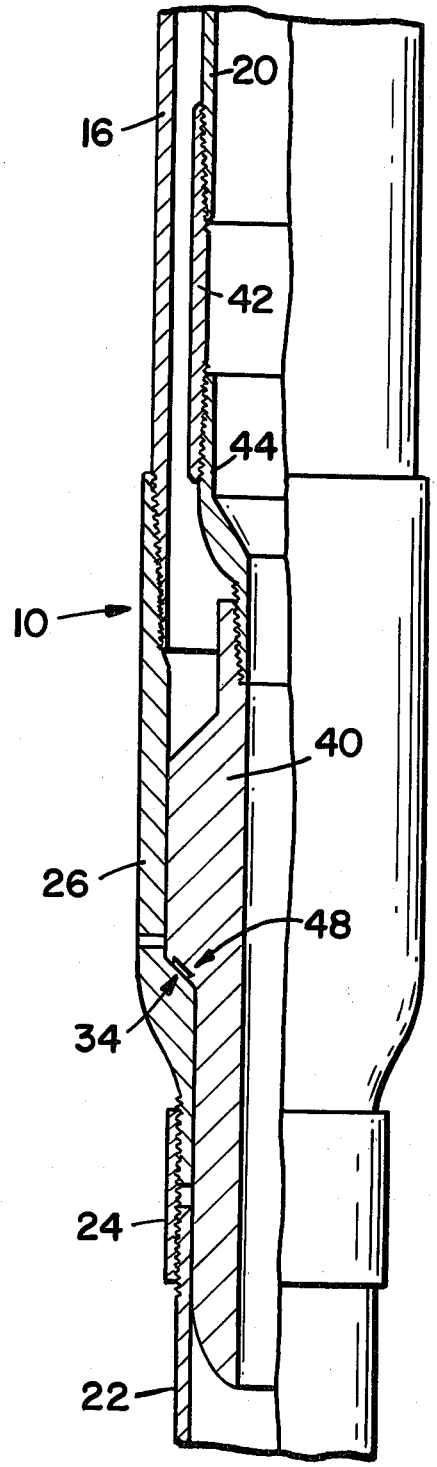
FIG. 2 is a partial sectional view through the packerless completion assembly when assembled for injection or production from a subsurface formation.

FIG. 2 illustrates the assembled internals of a packerless completion assembly in its functional position in a subsurface formation. The subsurface formation is not herein illustrated as such illustration would not provide information needed in understanding the internals of the assembly. It should, of course, be understood that the large diameter casing 16, the coupling 24 and the reduced diameter casing 22 are cemented to the formation along the well bore as illustrated in FIG. 1.

FIGS. 4 through 9 illustrate elements of the assembly and subassemblies of the packerless completion assembly.

As previously described, the packerless completion assembly of the present invention has particular application in steam injection wells where the formation of interest is a substantial distance below the earth surface and wellhead. The assembly is intended to be securely cemented to the formation at its exterior surface so as to provide a complete seal between the casing, and the assembly and the surrounding earth formation along the well bore. The casing and the formation below the packerless completion assembly is intended to be prepared for steam or hot fluid injections or for the production of petroleum crudes from the formation. In either event, the casing at the formation of interest is perforated or provided with a suitable injection assembly to permit fluids to flow from the casing into the formation and fluids to flow from the formations into the casing.

In producing such a subsurface completion, the packerless completion assembly of the present invention is run into the well bore on the end of the producing casing and positioned at the desirable subsurface location. Other well bore equipment is then run down through the casing, through the subsurface packerless completion assembly and into the reduced diameter casing 22 where suitable subsurface equipment has been placed to inject the cementing material into the well bore to effect the desired cemented contact with the formation. The apparatus for positioning the cement along the exterior of the casing is not herein disclosed as such equipment is well known oil field equipment.

After cementing has been completed, additional well equipment may be transported down the interior of the casing 16 and through the packerless completion assembly to produce the desired casing perforations or subsurface treatments below the assembly to prepare the formation and the well bore for injection or production.

Figure 3:
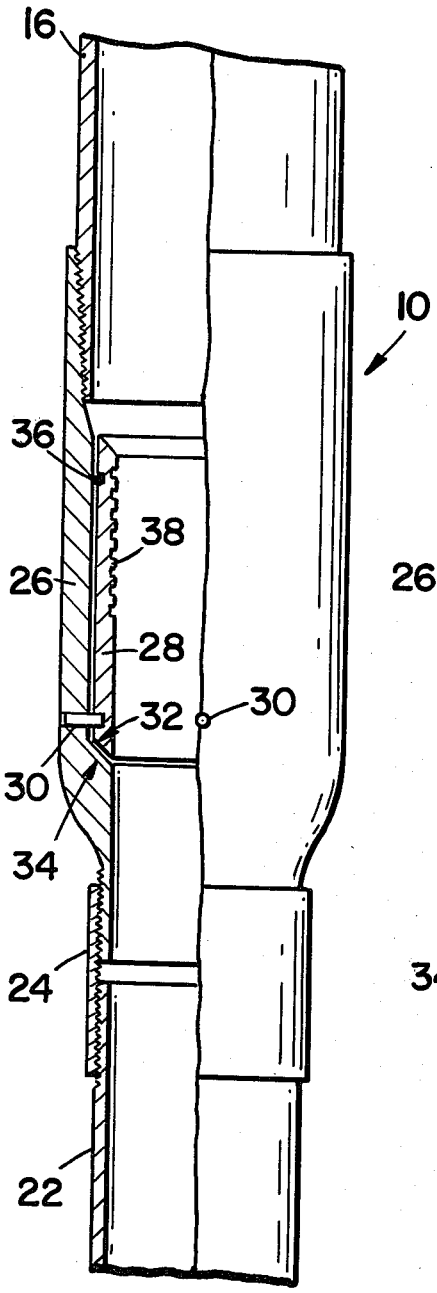
FIG. 3 is a partial sectional view through a portion of a subassembly of the packerless completion assembly.
Figure 5:
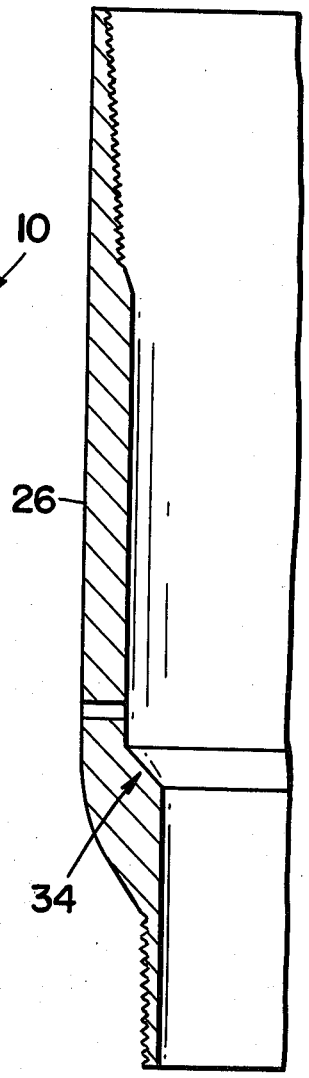
FIGS. 4 and 5 are partial sectional views through portions of the packerless completion assembly.
Figure 4:
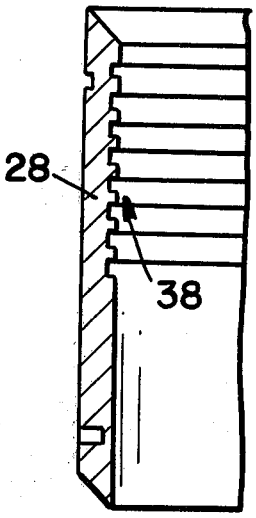

FIG. 3 illustrates the initial assembly of the subsurface well completion apparatus when in use for initially completing the subsurface well. The casing 16 is shown connected in threaded engagement with the assembly 10 which includes a cross-over adaptor 26 threaded to the casing at its upper end and threaded at its lower end to the coupling 24 and the reduced diameter casing 22. The cross-over adaptor 26 is intended to reduce the diameter of the upper casing to the diameter of the lower casing and to provide a protectable and sealable working surface along the internals of the cross-over adaptor. As illustrated in FIG. 3, a drilling adaptor 28 is held within the cross-over adaptor by a plurality of shear pins 30. The drilling adaptor includes a lower face 32 engaging a sealing surface 34 and an O-ring 36 for establishing a seal of the minor annulus between the exterior of the drilling adaptor and the interior of the cross-over adaptor. The internal surface of the drilling adaptor is provided with suitable threads 38 which permit the drilling adaptor to be engaged by a mating threaded unit which can be carried down the interior of the casing to provide for connection to the drilling adaptor in a function to be more fully described hereinafter. In the assembly shown in FIG. 3 composed of the parts shown in FIGS. 4 and 5, the drilling adaptor serves the function of protecting the sealing surface 34 during further completion of the well below the packerless completion assembly and while the assembly is being cemented in place.

Figure 6:
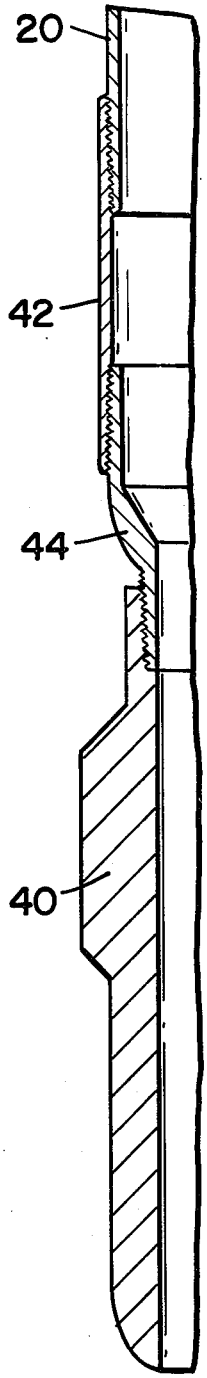
FIG. 6 is a partial section view through the internal string portions of the subsurface completion assembly.
Figure 7:
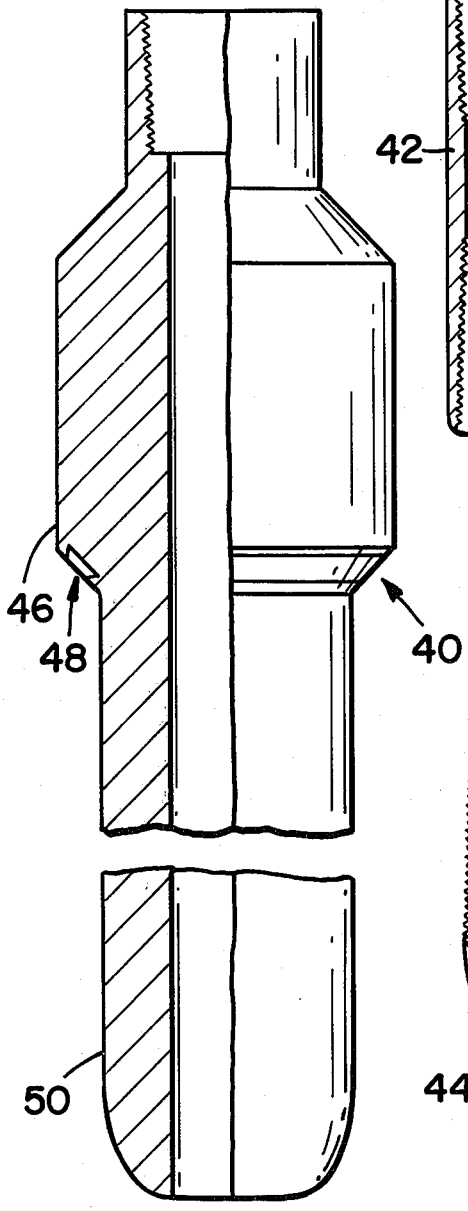
FIGS. 7, 8 and 9 are partial sectional views through elements of the internal portions of the packerless completion assembly as shown in FIG. 6.
Figure 8:
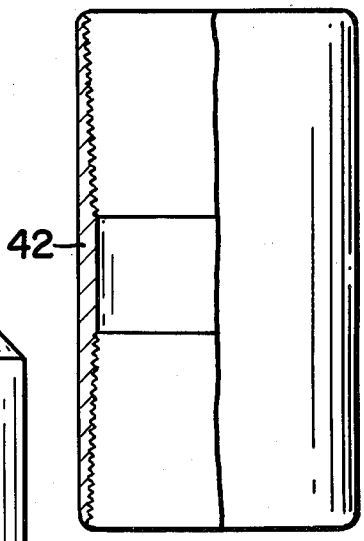
Figure 9:
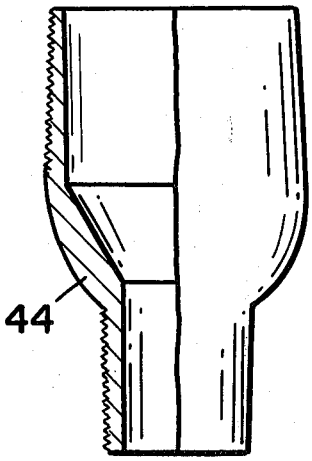

FIG. 2 illustrates the subsurface completion assembly with the sealing adaptor 40 in place on the end of the internal tubing string 20. The assembly of the sealing adaptor on the end of the tubing string is shown in FIG. 6 with the components thereof being individually shown in FIGS. 7, 8 and 9. As illustrated, the tubing string 20 is threaded into a coupling 42 and a cross-over element 44 is threaded to the coupling at one end and to the upper end of the sealing adaptor 40 at its other end to produce a reduced diameter assembly on the end of the casing string 20. The sealing adaptor 40 includes an enlarged shoulder portion 46 having a machined face 48 for establishing a smooth surface for engagement with the sealing surface 34 of the cross-over adaptor 26. The lower end of the sealing adaptor is formed with an extension 50, frequently referred to in the oil field terms as a "stinger", which provides for guidance of the sealing adaptor into the cross-over adaptor and the proper engagement of the sealing surface 34 and machined face 48. The internals of the sealing adaptor 40 are hollow to permit the fluids to be injected down the internal tubing string or to permit production to pass upwardly to the wellhead.

When in position, as shown in FIG. 2, the sealing adaptor 40 makes a firm engagement between the sealing surface 34 and the machined face 48 so as to establish a complete seal of the annulus between the internal tubing string and the interior of the casing 16. The pressure to accomplish the desired seal is produced by the weight of the tubing string on the sealing adaptor. In that manner, the packerless completion assembly of the present invention provides for a complete seal of the subsurface well bore derived entirely from the weight of the tubing string against the matching sealing surfaces of the subsurface cross-over adaptor. With the adaptor firmly cemented into the formations and with a tubing string having an adequate weight, the entire subsurface completion is accomplished without the need for conventional expandable packing equipment. The invention has particular application to high pressure and high temperature steam injection wells where it has been difficult to develop subsurface packing equipment that can withstand the temperatures and the pressures of the steam being injected. In some of the subsurface wells, the temperatures range from 300° to 360° F. and the pressures range from 2000 to 2500 psi.

While it has not been specifically here illustrated, it should be understood that in the case of a steam injection well, the internal tubing string 20 may be suitably centralized along the well bore between the subsurface packerless completion assembly and the wellhead. Further, when steam injection tubing is contemplated as the use for the subsurface packerless completion assembly, it should be recognized that the internal tubing string may undergo thermal expansion and the well will have to be adapted to accommodate such thermal expansion either at the wellhead 23 or at an expansion joint provided along the tubing string. With such an accommodation damage to the tubing by buckling is prevented.

As previously described, the cross-over adaptor is run into the well on the end of the casing 16 as an initial assembly with the drilling adaptor 28 in position held in place by shear pins 30. After the subsurface well has been completed, and the cross-over adaptor 26 has been firmly secured in place, a working tool is run into the well with a threaded member at its end having matching threads with the threads 38 in the drilling adaptor 28. After making engagement with the threads and producing a secure fit, additional torque is applied to the working string to shear pins 30 thus permitting the drilling adaptor to be removed. Upon removal, the sealing surface 34 is then exposed and the internals of the packerless completion assembly is prepared to receive the sealing adaptor 40. It should be understood that the drilling adaptor 28 may be of any suitable construction which would permit it to be engaged by a tool run into the well to retrieve the adaptor and, in that case, the threads 38 would not be needed. However, the adaptor itself may not be available for reuse at another time.

While a certain preferred embodiment of the invention has been specifically disclosed, it should be understood that the invention is not limited thereto as many variations will be readily apparent to those skilled in the art and the invention is to be given its broadest possible interpretation within the terms of the following claims.

What is claimed is:

1. A deep subsurface injection or producing well completion assembly adapted for use with a well having casing cemented to the subsurface formations at or near the injection or production interval of said well comprising:

(a) a hollow cross-over adaptor attached to said casing and cemented with said casing to said subsurface formations, (b) a formed sealing surface on the internal surface of said hollow cross-over adaptor, (c) and means including tubing within said casing having a sealing face at its subsurface end cooperating with said sealing surface of said cross-over adaptor to effect a completion of said subsurface well at said cross-over adaptor within said subsurface formation.

2. A subsurface well completion assembly comprising:

(a) a first diameter casing fixed to said subsurface formation, (b) a second diameter casing having a smaller diameter than said first diameter casing and fixed to said subsurface below said first diameter casing, (c) a cross-over adaptor fixed to both said first and second diameter casing, (d) a sealing surface within said cross-over adaptor, (e) a sealing adaptor within said cross-over adaptor, said adaptor being hollow along the axis of said well and having an external sealing face for cooperation with said sealing surface of said cross-over adaptor, (f) and a tubing string within said first diameter casing including means for attaching said sealing adaptor to said tubing string, (g) said sealing adaptor being positionable by said tubing string to engage said sealing face with said sealing surface and adapted to produce a seal between said sealing adaptor and said cross-over adaptor due to the weight of said tubing string on said sealing face engagement with said sealing surface.

3. The subsurface completion assembly of claim 2 wherein said sealing adaptor is formed with a reduced diameter guiding extension below said sealing face to position said sealing face in alignment with said sealing surface.

4. A packerless completion assembly for use in a subsurface completion of a well having well casing and an internal tubular member comprising:

(a) a cross-over adaptor having threaded portions at each end for cooperation with threaded portions of said well casing, said cross-over adaptor having an internal sealing face, (b) a drilling adaptor within said cross-over adaptor, (c) releasable means in said cross-over adaptor for releasably connecting said drilling adaptor within said cross-over adaptor said drilling adaptor including means for protecting said internal sealing face of said cross-over adaptor and being releasable at said releasable means so as to be removable from within said cross-over adaptor leaving said cross-over adaptor in place with said internal sealing face exposed, (d) a sealing adaptor threadedly fixed to the subsurface end of said internal tubular member, said sealing adaptor including a hollow axial guide extension at its lower end and an external machined face above said extension for coopertion with said internal sealing face in said cross-over adaptor, (e) said subsurface completion being accomplished by supporting said internal tubular member on said cross-over adaptor at said sealing face with said machined face of said sealing adaptor after removal of said drilling adaptor from said cross-over adaptor.

5. The packerless completion assembly of claim 4 wherein said well casing and cross-over adaptor are cemented to said subsurface along said well.

6. A tool for placing and completing a subsurface steam injection conduit within a well comprising:

(a) a cross-over adaptor with a releasable internal drilling adaptor and a permanent sealing face, (b) means for releasing said drilling adaptor from said cross-over adaptor to permit said drilling adaptor to be removed from said cross-over adaptor, (c) a sealing adaptor insertable in said cross-over adaptor after said drilling adaptor has been removed from said cross-over adaptor and said well, (d) means including said injection conduit for running said sealing adaptor into said cross-over adaptor in said well, (e) and means on said sealing adaptor for cooperating with said sealing face on said cross-over adaptor to seal said well below said cross-over adaptor from said well above said cross-over adaptor.

7. A method for effecting a subsurface well completion from the well head of a well to a deep subsurface injection or production zone comprising:

(a) placing a cross-over adaptor within said well at said deep subsurface location, said cross-over adaptor being between first and second casing elements, said cross-over adaptor and said casing elements being cemented to said subsurface, said cross-over adaptor being hollow and having a sealing surface along its inner surface, (b) placing a sealing adaptor into said cross-over adaptor on the lower end of a tubing string within said first casing, said sealing adaptor being hollow and having a sealing face along its outer surface, said sealing face having mating dimensions with respect to said sealing surface on said cross-over adaptor, said sealing face and said sealing surface being designed to establish a substantially fluid tight seal at said cross-over adaptor by press fit engagement therebetween, said tubing string being supported from said well head, (c) and pressing said sealing face of said sealing adaptor against said sealing surface of said cross-over adaptor under the weight of said tubing string from said well head to effect said well completion at said cross-over adaptor.

* * * * *